US008900328B2

(12) United States Patent
De Buzzaccarini et al.

(10) Patent No.: US 8,900,328 B2
(45) Date of Patent: Dec. 2, 2014

(54) CLEANING METHOD

(75) Inventors: Francesco De Buzzaccarini, Breendonk (BE); Raphael Angeline Alfons Ceulemans, Holsbeek (BE); Matthew Thomas Heisey, Cincinnati, OH (US); Edward Robert Offshack, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1028 days.

(21) Appl. No.: 12/719,202

(22) Filed: Mar. 8, 2010

(65) Prior Publication Data

US 2010/0229313 A1 Sep. 16, 2010

Related U.S. Application Data

(60) Provisional application No. 61/160,432, filed on Mar. 16, 2009.

(51) Int. Cl.

| | |
|---|---|
| ***C11D 3/37*** | (2006.01) |
| ***D06F 35/00*** | (2006.01) |
| ***C11D 11/00*** | (2006.01) |
| ***C11D 3/00*** | (2006.01) |

(52) U.S. Cl.

CPC ..... *C11D 3/0036* (2013.01); *C11D 3/3715* (2013.01); *C11D 11/0017* (2013.01)

USPC ..... 8/137

(58) Field of Classification Search

CPC . C11D 3/0036; C11D 11/0017; C11D 3/3715

USPC ..... 8/137, 137.5, 158

See application file for complete search history.

(56) References Cited

U.S. PATENT DOCUMENTS

| | | | | |
|---|---|---|---|---|
| 3,959,230 | A | 5/1976 | Hays | |
| 4,132,680 | A | 1/1979 | Nicol | |
| 4,702,857 | A | 10/1987 | Gosselink | |
| 4,740,326 | A * | 4/1988 | Hortel et al. | 510/295 |
| 5,496,490 | A | 3/1996 | Beagle et al. | |
| 5,968,893 | A * | 10/1999 | Manohar et al. | 510/475 |
| 6,200,351 | B1 | 3/2001 | Schleinig et al. | |
| 6,358,914 | B1 | 3/2002 | Gabriel et al. | |
| 6,554,869 | B2 * | 4/2003 | Aubay et al. | 8/137 |
| 7,214,247 | B2 * | 5/2007 | Eason et al. | 8/137 |
| 7,691,618 | B2 | 4/2010 | Wieland et al. | |
| 7,967,871 | B2 * | 6/2011 | Gibbs et al. | 8/137 |
| 2002/0042354 | A1 * | 4/2002 | Lang et al. | 510/426 |
| 2005/0043200 | A1 * | 2/2005 | Barry et al. | 510/421 |
| 2006/0205631 | A1 * | 9/2006 | Smerznak et al. | 510/515 |
| 2007/0105739 | A1 * | 5/2007 | Wahl et al. | 510/295 |
| 2007/0277327 | A1 * | 12/2007 | Wessling et al. | 8/137 |
| 2008/0032909 | A1 * | 2/2008 | de Buzzaccarini et al. | 510/293 |

FOREIGN PATENT DOCUMENTS

| | | |
|---|---|---|
| CA | 1297625 | 3/1992 |
| EP | 1005890 A1 | 6/2000 |
| GB | 1154730 | 6/1969 |
| WO | WO 92/17523 A1 | 10/1992 |
| WO | WO 96/21720 | 7/1996 |
| WO | WO 96/24657 A1 | 8/1996 |
| WO | WO 99/41346 A1 | 8/1999 |

OTHER PUBLICATIONS

U.S. Appl. No. 12/719,183, filed Mar. 8, 2010, Francesco de Buzzaccarini.

International Search Report 10 Pages, Sep. 20, 2011.

* cited by examiner

*Primary Examiner* — Joseph L Perrin

(74) *Attorney, Agent, or Firm* — Gregory S. Darley-Emerson; Steven W. Miller

(57) ABSTRACT

A method of cleaning a textile load in a professional laundry machine the method comprises subjecting the load to main-wash, rinse and optionally pre-wash cycles wherein the load is contacted during a rinse cycle with a liquor containing a low level of soil release polymer.

11 Claims, No Drawings

CLEANING METHOD

CROSS REFERENCE TO RELATED APPLICATION(S)

This application claims the benefit of U.S. Provisional Application Ser. No. 61/160,432, filed Mar. 16, 2009.

TECHNICAL FIELD

The present invention is in the field of laundry. In particular, it relates to a method of industrial or institutional laundry using a soil release polymer during the wash process.

BACKGROUND OF THE INVENTION

Even though the principles that determine the effectiveness of detergents for household (or home) and professional (including institutional and industrial) laundries are similar, detergents for large-scale institutional or industrial use generally differ insofar as they must be designed to meet the special circumstances associated with laundry on an industrial scale and/or in an institutional context. Contrary to home laundry, professional laundries have to deal with large volumes of textile items and require therefore completely automatic processing with microprocessor-controlled machines and dosing units. The length of the washing process differs from that of home laundry and in some cases the washing is performed with soft water. Soil levels can be significantly higher in certain types of loads of professional laundry (restaurant linens for example) than in household laundry and the loads are considerably bigger. The composition of the loads is more uniform, in terms of both, types of fabrics and soils. Typically the same kinds of fabrics stained with the same kind of soils are washed together. For example a typical commercial laundry load will consist of only towels, only bed linen or only tablecloths and napkins.

Table linen (tablecloths and napkins) represents a heavy demand load for professional foodservice. The linen is soiled with difficult greasy stains. Large unique loads of these items are washed routinely together. Repeat loads of these items happen frequently with repeated re-use of the fabrics within the foodservice venue. Sometimes fabrics are pre-treated from the manufacture in order to facilitate soil removal, but it can wear off upon the numerous repeated re-use/rewash. The removal of stains can be more challenging in professional laundry than in the case of domestic laundry, especially in the professional foodservice sector.

The removal of food stains, especially on polyester and in particular on table linen in professional laundry has not been successfully solved. Several solutions have been proposed using soil release polymers. WO96/24657 discloses high alkalinity detergent composition comprising non-ionic surfactant and a soil release polymer. The composition is in powder form and it is delivered into the main wash of an institutional textile washing process. U.S. Pat. No. 6,200,351 relates to an institutional textile washing process in which a soil release polymer is used in a separate pre-treatment step.

The solutions proposed by the prior art involve harsh conditions (extremely high pH) and/or large amount of soil release polymer and/or a separate step to the washing process. One of the objectives of this invention is to provide a method of professional laundry which is gentle with the treated textiles and at the same time is economic and easy to implement.

SUMMARY OF THE INVENTION

According to a first aspect of the invention, there is provided a method of cleaning a textile load in a professional laundry machine the method comprises subjecting the load to main-wash, rinse and optionally pre-wash cycles wherein the method comprises the step of contacting the load during a rinse cycle with a liquor containing a soil release polymer. The method of the invention provides excellent soil removal, in particular removal of food stains, including not only greasy stains but also water-based stains.

Best soil removal is obtained when the level of soil release polymer per kilogram of load is from about 0.01 to about 0.8 grams, preferably when the level of polymer is less than 0.2 grams. Thus according to a preferred embodiment the level of soil release polymer per kilogram of load is from about 0.01 to about 0.8 grams, more preferably from about 0.04 to about 0.2 grams and especially from about 0.05 to about 0.15 grams.

According to a second aspect of the invention, there is provided a method of cleaning a textile load in a professional laundry machine the method comprises subjecting the load to main-wash, rinse and optionally pre-wash cycles wherein the method comprises the step of contacting the load during a main-wash and/or a rinse cycle with a liquor containing a soil release polymer wherein the level of soil release polymer per kilogram of load is from about 0.01 to about 0.8 grams, preferably from about 0.04 to about 0.2 grams and more preferably from about 0.05 to about 0.15 grams.

According to a third aspect of the invention, there is provided a method of cleaning a textile load in a professional laundry machine the method comprises subjecting the load to main-wash, rinse and optionally pre-wash cycles wherein the method comprises the step of contacting the load during the washing process with a liquor containing a soil release polymer and wherein the soil release polymer is provided in the form of an additive, i.e., as a separate composition from the main detergent.

Improved stain removal is achieved when the soil release polymer is a copolymer having the formula:

$$X-[(OCH_2CH_2)_n-[(\overset{O}{\overset{\|}{C}}-R^1-\overset{O}{\overset{\|}{C}}O-R^2)_u(-\overset{O}{\overset{\|}{C}}-R^3-CO-R^2)_v]-\overset{O}{\overset{\|}{C}}-R^4-\overset{O}{\overset{\|}{C}}O-(CH_2CH_2O)_n-X$$

wherein:

each $R^1$ moieties is a 1,4-phenylene moiety;

the $R^2$ moieties are each selected from the group consisting of ethylene moieties, 1,2-propylene moieties, 1,2 butylene moieties, 1,2 hexylene moieties, 3-methoxy-1,2 propylene moieties or mixture thereof, provided that said $R^2$ are not exclusively 1,2 butylene moieties, 1,2 hexylene moieties, 3-methoxy-1,2 propylene moieties or mixture thereof; preferably $R^2$ is a 1,2-propylene moiety.

the $R^3$ moieties are each selected from the group consisting of substituted 1,3-phenylene moieties having the substituent $$-\overset{O}{\overset{\|}{C}}O-[(R^2-\overset{O}{\overset{\|}{C}}-R^4-\overset{O}{\overset{\|}{C}}O)]_w-(CH_2CH_{22}O)_n-X$$

at the 5 position;

the $R^4$ moieties are $R^1$ or $R^3$ moieties, or mixtures thereof;

each X is C1-C4 alkyl; each n is from 12 to 43;

when w is 0, u+v is from 3 to 10;

when w is at least 1, u+v+w is from 3 to 10.

Preferably w is 0.

Preferred soil release polymer for use herein is a copolymer comprising propylene glycol derived moieties, terephthalate moieties and capped polyethylene glycol derived moieties. Preferably the capped polyethylene glycol used is CH3O(CH2CH2O)nOH, wherein n is an integer from 12 to 44, preferably from 20 to 42 and more preferably from 25 to 41 and especially 40. Improved performance is obtained with this kind of copolymers.

The prefer copolymer for use herein has the following formula:

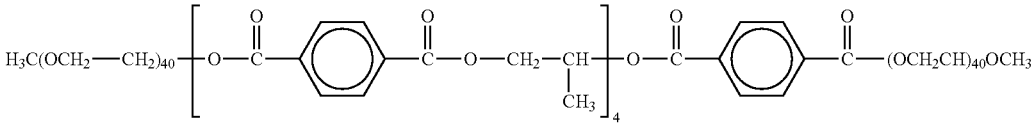

Preferably the soil release polymer has a molecular weight above about 2,000, more preferably above about 3,000 and more preferably above about 4,000. Methods in which soil release polymers having molecular weight above 4,000 have been used provide outstanding results in terms of stain removal. Preferably the molecular weight is below about 20,000. With reference to the polymers described herein, the term "molecular weight" is the weight-average molecular weight as determined using gel permeation chromatography according to the protocol found in Colloids and Surfaces A. Physico Chemical & Engineering Aspects, Vol. 162, 2000, pg. 107-121. The units are Daltons.

Preferably, the method of the invention, in terms of cleaning products, uses a base detergent and an additive. Preferably, the soil release polymer is in the form of an additive. This not only obviates the process challenges found to make the soil release polymer part of a base detergent but also eliminates the interaction between some of the base detergent ingredients and the polymer and gives flexibility in terms of dosing.

Preferably the additive is in liquid form so it can be easily delivered by means of a displacement pump, for example a peristaltic pump. The additive is preferably an aqueous structured liquid, usually the soil release polymer is insoluble in aqueous solution and it is suspended by means of an external structurant. Structured liquids can either be internally structured, whereby the structure is formed by primary ingredients (e.g. surfactant material) and/or externally structured by providing a three dimensional matrix structure using secondary ingredients (e.g. polymers, clay and/or silicate material). The additive comprises the soil release polymer, preferably in an amount of from about 1% to about 50%, more preferably from about 5% to about 20% by weight of the additive. The additive can further comprise an external structurant to keep the soil release polymer suspended. Levels of external structurants of from about 0.05 to about 5%, more preferably from about 0.1 to about 2% and especially from about 0.1 to about 1% by weight of the additive have been found particularly suitable to keep the polymer suspended. Preferred external structurant for use herein is xanthan gum. Preferably the additive comprises a preservative, more preferred in a level of from about 0.05 to about 3% and especially from about 0.1 to about 1% by weight of the additive. A dye is another prefer component of the additive of the invention. Preferably the additive is free of builders and/or surfactants.

The method of the invention provides benefits after one wash. The benefits are even better after a plurality of washes, in particular after three washes. Thus, in preferred embodiments the method of the invention is performed a plurality of times, preferably at least three times.

Professional laundry and in particular loads comprising polyester materials seems to generate a high level of suds that negatively impact in the soil removal process. Improved results are obtained when the wash liquor, preferably the liquor of the main wash, comprises a suds suppressor. Thus in preferred embodiments of the invention the wash liquor of the invention comprise a suds suppressor, preferably the suds suppressor is part of the base detergent.

The method of the invention provides good soil removal even when soft water is used. In preferred embodiments the liquor of the method of the invention, preferably the liquor of each cycle, has a hardness, i.e., Ca and Mg ions concentration, of less than about 4, preferably less than about 1 and especially less than about 0.5 mmoles/liter.

In preferred embodiments the wash liquor, preferably the wash liquor of the main wash, has a pH of from about 7 to about 10, preferably from about 8 to about 9, as measured at room temperature (20° C.) this allows not only for good cleaning but also for good care of the washed articles.

Usually textiles are treated with starch to provide stiffness, it has been found that starch negatively impact on the removal of greasy soils. This negatively interaction is ameliorated if the starch is delivery simultaneously or after the soil release polymer.

The method of the invention not only provides good cleaning but also imparts allergen repelancy to the washed articles. Textiles loads treated in the wash with a polymeric soil release agents are less prone to retain dust and allergens.

As used herein, the term "allergen" is meant to include any substances that are capable of sensitizing and inducing an allergic reaction in a host such as human being. Allergens which can be removed from textiles and fabrics, in accordance with the present invention, include, for example, animal allergens such as animal dander and animal saliva, plant allergens such as pollen, fungi, cockroach allergens, and house dust mite allergens including house dust mite feces. All of these allergens are often found in house dust.

DETAILED DESCRIPTION OF THE INVENTION

The present invention envisages a method of professional laundry. The method involves the delivery of low levels of soil release polymer and produces outstanding soil removal, in particular in polyester articles but also in cotton articles. The method is particularly suitable for loads comprising high level of highly soiled polyester items. The invention also envisages an additive comprising soil release polymer, preferably suspended in an aqueous externally structured solution, for use in professional laundry. The additive obviates interactions between different cleaning ingredients and allows for flexibility of use.

Professional laundry includes institutional and industrial (sometimes also referred to as commercial) laundry. Institutional laundry refers to textile washing operations usually run in business sites, normally referred to as On-Premise or In-House Laundry Operations. Typical businesses can be for instance hotels, restaurants, care homes, hospitals, spas, health or sport clubs, schools, and similar institutions. Industrial laundry refers to textile washing operations carried out in dedicated places typically for the above businesses.

By "professional laundry machine" is herein meant a laundry machine which a capacity higher than 8 kg, preferably higher than 15 kg and more preferably higher than 25 kg of dry laundry.

There are two main types of professional laundry machines: front load which operate in a batch mode or tunnel washing machines that operate in continuous mode. The professional laundry machines for use herein, in the case of front load have a drum volume of at least about 0.15 $m^3$, preferably at least 0.2 $m^3$, more preferably at least 0.3 $m^3$ and especially at least 0.5 $m^3$. The professional laundry machines for use herein, in the case of front load have a drum diameter of at least about 0.5 m, preferably at least 0.8 m and more preferably at least 1 m. In the case of tunnel washing machines the tunnel has a diameter of at least about 1.5 m, preferably at least 3 m and more preferably at least 5 m.

Preferably the textile load is a polyester load. By polyester load is understood a load comprising at least about 50%, preferably at least about 60%, more preferably at least about 80% and more preferably at least 90% by weight of the load of polyester items. Cleaning benefits are obtained in this kind of loads although benefits are also seen in any textiles having a hydrophobic surface, independently of the composition of the textile.

Preferably the method of the invention involves the delivery of a base detergent in the main wash and a soil release containing additive either in the rinse or in the main wash.

Polymer Soil Release Agent

Soil release polymers enhance the laundry cleaning efficacy by improving release of grease and oil during the laundry process. See soil release agents' definition, p. 278-279, "Liquid Detergents" by Kuo-Yann Lai. For use herein, preferred level of soil release polymer per kilogram of load is from about 0.01 to about 0.8 grams, more preferably the level of polymer is less than 0.2 grams especially from about 0.05 to about 0.15 grams. Contrary to what one would expect higher levels of soil release polymer do not enhance removal. In some cases removal is worse than with lower levels.

The soil release polymer used in the method of the present invention includes a variety of charged, e.g., anionic or cationic (see U.S. Pat. No. 4,956,447), as well as non-charged monomer units and structures may be linear, branched or star-shaped. They may include capping moieties which are especially effective in controlling molecular weight or altering the physical or surface-active properties.

Suitable soil release polymers for use herein include a sulfonated product of a substantially linear ester oligomer comprised of an oligomeric ester backbone of terephthaloyl and oxyalkyleneoxy repeat units, for example as described in U.S. Pat. No. 4,968,451. Suitable soil release polymers for use herein include also polymer such as defined in U.S. Pat. No. 4,711,730, for example those produced by transesterification/oligomerization of poly(ethyleneglycol) methyl ether, dimethyl terephthalate ("DMT"), propylene glycol ("PG") and poly(ethyleneglycol) ("PEG"). Suitable polymers also include polymers defined in partly- and fully-anionic-end-capped oligomeric esters of U.S. Pat. No. 4,721,580, such as oligomers from ethylene glycol ("EG"), PG, DMT and Na-3,6-dioxa-8-hydroxyoctanesulfonate; also the nonionic-capped block polyester oligomeric compounds of U.S. Pat. No. 4,702,857, for example produced from DMT, Me-capped PEG and EG and/or PG, or a combination of DMT, EG and/or PG, Me-capped PEG and Na-dimethyl-5-sulfoisophthalate; and also the anionic, especially sulfoaroyl, end-capped terephthalate esters of U.S. Pat. No. 4,877,896.

Soil release polymers suitable for use herein also encompass simple copolymeric blocks of ethylene terephthalate or propylene terephthalate with polyethylene oxide or polypropylene oxide terephthalate (see U.S. Pat. No. 3,959,230 and U.S. Pat. No. 3,893,929) cellulosic derivatives such as the hydroxyether cellulosic polymers available as METHOCEL from Dow; and the $C_1$-$C_4$ alkylcelluloses and $C_4$ hydroxyalkyl celluloses.

Soil release polymers for use herein also encompass polymer characterised by poly(vinyl ester) hydrophobic segments including graft copolymers of poly(vinyl ester), e.g., $C_1$-$C_6$ vinyl esters, preferably poly(vinyl acetate), grafted onto polyalkylene oxide backbones (see U.S. Pat. No. 4,000,093 and EP 0219048). Commercially available examples of soil release polymers include SOKALAN®, such as SOKALAN HP-22®, available from BASF.

Other soil release polymers of the present invention can be polyesters with repeat units containing 10-15% by weight of ethylene terephthalate together with 90-80% by weight of polyoxyethylene terephthalate, derived from a polyoxyethylene glycol of average molecular weight 300-5,000. Commercial examples include ZELCON® 5126 from Dupont and MILEASE® from ICI.

Suitable monomers for the above soil release polymers include Na 2-(2-hydroxyethoxy)-ethanesulfonate, DMT, Na-dimethyl 5-sulfoisophthalate, EG and PG (U.S. Pat. No. 5,415,807).

Additional classes of soil release polymer suitable for use herein include:

(I) nonionic terephthalates using diisocyanate coupling agents to link up polymeric ester structures (see U.S. Pat. No. 4,201,824 and U.S. Pat. No. 4,240,918);

(II) soil release polymers with carboxylate terminal groups made by adding trimellitic anhydride to known soil release polymers to convert terminal hydroxyl groups to trimellitate esters. With a proper selection of catalyst, the trimellitic anhydride forms linkages to the terminals of the polymer through an ester of the isolated carboxylic acid of trimellitic anhydride rather than by opening of the anhydride linkage. Either nonionic or anionic soil release polymers of the present invention may be used as starting materials as long as they have hydroxyl terminal groups which may be esterified (See U.S. Pat. No. 4,525,524);

(III) anionic terephthalate-based soil release polymers of the urethane-linked variety (see U.S. Pat. No. 4,201,824);

(IV) poly(vinyl caprolactam) and related co-polymers with monomers such as vinyl pyrrolidone and/or dimethylaminoethyl methacrylate, including both nonionic and cationic polymers (U.S. Pat. No. 4,579,681);

(V) graft copolymers, in addition to the SOKALAN® types made from BASF, by grafting acrylic monomers on to sulfonated polyesters; these soil release polymers have soil release and anti-redeposition activity similar to known cellulose ethers (see EP 279,134);

(VI) grafts of vinyl monomers such as acrylic acid and vinyl acetate on to proteins such as caseins (see EP 457,205);

(VII) polyester-polyamide soil release polymers prepared by condensing adipic acid, caprolactam, and polyethylene glycol, especially for treating polyamide fabrics (see DE 2,335, 04). Other useful soil release polymers are described in U.S. Pat. Nos. 4,240,918, 4,787,989, 4,525,524 and 4,877,896.

In a preferred embodiment, the soil release polymer for use herein has the formula:

$$X—[(OCH_2CH_2)_n(OR^5)_m]-[(A-R^1-A-R^2)_u(A-R^3-A-R^2)_v]-A-R^4-A-[(R^5O)_m(CH_2CH_2O)]X$$

In this formula, the moiety $[(A-R^1-A-R^2)_u(A-R^3-A-R^2)_v]$-A-$R^4$-A- forms the oligomer or polymer backbone of the compounds. Groups $X—[(OCH_2CH_2)_n(OR^5)_m]$ and $[(R^5O)_m(CH_2CH_2O)_n]—X$ are generally connected at the ends of the oligomer/polymer backbone.

The linking A moieties are essentially

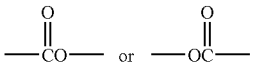

moieties, i.e. the compounds of the present invention are polyesters.

As used herein, the term "the A moieties are essentially

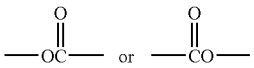

moieties" refers to compounds where the A moieties consist entirely of moieties

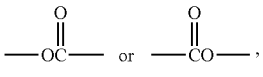

or are partially substituted with linking moieties such as

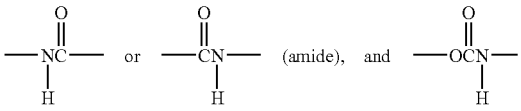

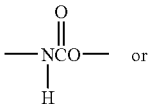

(urethane). The degree of partial substitution with these other linking moieties should be such that the soil release properties are not adversely affected to any great extent. Preferably, linking moieties A consist entirely of (i.e., comprise 100%) moieties

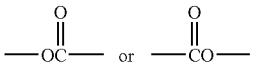

i.e., each A is either

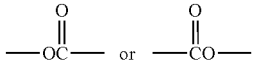

The $R^1$ moieties are essentially 1,4-phenylene moieties.

As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2'-biphenylene, 4,4'-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50 to 100%, 1,4-phenylene moieties (from 0 to 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fibber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e. each $R^1$ moiety is 1,4-phenylene.

The $R^2$ moieties are essentially ethylene moieties, or substituted ethylene moieties having $C_1$-$C_4$ alkyl or alkoxy substituents. As used herein, the term "the $R^2$ moieties are essentially ethylene moieties, or substituted ethylene moieties having $C_1$-$C_4$ alkyl or alkoxy substituents" refers to compounds of the present invention where the $R^2$ moieties consist entirely of ethylene, or substituted ethylene moieties, or are partially substituted with other compatible moieties. Examples of these other moieties include linear $C_3$-$C_6$ alkylene moieties such as 1,3-propylene, 1,4-butylene, 1,5-pentylene or 1,6-hexamethylene, 1,2-cycloalkylene moieties such as 1,2-cyclohexylene, 1,4-cycloalkylene moieties such as 1,4-cyclohexylene and 1,4-dimethylenecyclohexylene, polyoxy-alkylated 1,2-hydroxyalkylenes such as

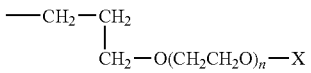

and oxy-alkylene moieties such as $$—CH_2CH_2OCH_2CH_2OCH_2CH_2— \text{ or } —CH_2CH_2OCH_2CH_2—$$

For the $R^2$ moieties, the degree of partial substitution with these other moieties should be such that the soil release properties of the compounds are not adversely affected to any great extent.

Generally, the degree of partial substitution which can be tolerated will depend upon the backbone length of the compound, i.e. longer backbones can have greater partial substitution. Usually, compounds where the $R^2$ comprise from 20 to 100% ethylene, or substituted ethylene moieties (from 0 to 80% other compatible moieties) have adequate soil release activity. For example, for polyesters made according to the present invention with a 75:25 mole ratio of diethylene glycol ($—CH_2CH_2OCH_2CH_2—$) to ethylene glycol (ethylene) have adequate allergen repellency activity. However, it is desirable to minimize such partial substitution, especially with oxyalkylene moieties, for best soil release activity.

Preferably, $R^2$ comprises from 80 to 100% ethylene, or substituted ethylene moieties, and from 0 to 20% other compatible moieties. For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixtures thereof. Inclusion of a greater percentage of ethylene moieties tends to improve the soil release activity of the compounds. Surprisingly, inclusion of a greater percentage of 1,2-propylene moieties tends to improve the water solubility of the compounds.

For the $R^3$ moieties, suitable substituted $C_2$-$C_{18}$ hydrocarbylene moieties can include substituted $C_2$-$C_{12}$ alkylene, alkenylene, arylene, alkarylene and like moieties. The substituted alkylene or alkenylene moieties can be linear, branched, or cyclic. Also, the $R^3$ moieties can be all the same (e.g. all substituted arylene) or a mixture (e.g. a mixture of substituted arylenes and substituted alkylenes). Preferred $R^3$ moieties are those which are substituted 1,3-phenylene moieties. The substituted $R^3$ moieties preferably have only one $—SO_3M$, —COOM, $—O[(R^5O)_m(CH_2CH_2O)_n]X$ or $-A[(R^2\text{-}A\text{-}R^4\text{-}A)]_w[(R^5O)_m(CH_2CH_2O)_n]X$ substituent.

M can be H or any compatible water-soluble cation. Suitable water soluble cations include the water soluble alkali metals such as potassium ($K^+$) and especially sodium ($Na^+$), as well as ammonium ($NH_4^+$). Also suitable are substituted ammonium cations having the formula:

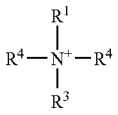

where $R^1$ and $R^2$ are each a $C_1$-$C_{20}$ hydrocarbyl group (e.g. alkyl, hydroxyalkyl) or together form a cyclic or heterocyclic ring of from 4 to 6 carbon atoms (e.g. piperidine, morpholine); $R^3$ is a $C_1$-$C_{20}$ hydrocarbyl group; and $R^4$ is H (ammonium) or a $C_1$-$C_{20}$ hydrocarbyl group (quat amine). Typical substituted ammonium cationic groups are those where $R^4$ is H (ammonium) or $C_1$-$C_4$ alkyl, especially methyl(quat amaine); $R^1$ is $C_{10}$-$C_{18}$ alkyl, especially $C_{12}$-$C_{14}$ alkyl; and $R^2$ and $R^3$ are each $C_1$-$C_4$ alkyl, especially methyl.

The $R^3$ moieties having $-A[(R^2\text{-}A\text{-}R^4\text{-}A)]_w[(R^5O)_m(CH_2CH_2O)_n]—X$ substituents provide branched compounds. $R^3$ moieties having $-A[(R^2\text{-}A\text{-}R^4\text{-}A)]_w\text{-}R^2\text{-}A$ moieties provide cross-linked compounds. Indeed, syntheses used to make the branched compounds typically provide at least some cross-linked compounds.

The moieties $—(R^5O)—$ and $—(CH_2CH_2O)—$ of the moieties $[(R^5O)_m(CH_2CH_2O)_n]$ and $[(OCH_2CH_2)_n(OR^5)_m]$ can be mixed together or preferably form blocks of $—(R^5O)—$ and $—(CH_2CH_2O)—$ moieties.

Preferably, the blocks of $—(R^5O)—$ moieties are located next to the backbone of the compound. When $R^5$ is the moiety $—R^2\text{-}A\text{-}R^6—$, m is 1; also, the moiety $—R^2\text{-}A\text{-}R^6—$ is preferably located next to the backbone of the compound.

For $R^5$, the preferred $C_3$-$C_4$ alkylene is $C_3H_6$ (propylene); when $R^5$ is $C_3$-$C_4$ alkylene, m is preferably from 0 to 5 and is most preferably 0. $R^6$ is preferably methylene or 1,4-phenylene. The moiety $—(CH_2CH_2O)—$ preferably comprises at least 75% by weight of the moiety $[(R^5O)_m(CH_2CH_2O)_n]$ and most preferably 100% by weight (m is 0). X can be H, $C_1$-$C_4$ alkyl or

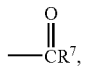

wherein $R^7$ is $C_1$-$C_4$ alkyl. X is preferably methyl or ethyl, and most preferably methyl. The value for each n is at least 6, but is preferably at least 10. The value for each n usually ranges from 12 to 113. Typically, the value for each n is in the range of from 12 to 43.

The backbone moieties $(A\text{-}R^1\text{-}A\text{-}R^2)$ and $(A\text{-}R^3\text{-}A\text{-}R^2)$ can be mixed together or can form blocks of $(A\text{-}R^1\text{-}A\text{-}R^2)$ and $(A\text{-}R^3\text{-}A\text{-}R^2)$ moieties. It has been found that the value of u+v needs to be at least 3 in order for the compounds of the present invention to have significant soil release activity. The maximum value for u+v is generally determined by the process by which the compound is made, but can range up to 25, i.e. the compounds of the present invention are oligomers or low molecular weight polymers. By comparison, polyesters used in fibber making typically have a much higher molecular weight, e.g. have from 50 to 250 ethylene terephthalate units. Typically, the sum of u+v ranges from 3 to 10 for the compounds of the present invention.

Generally, the larger the u+v value, the less soluble is the compound, especially when the $R^3$ moieties do not have the substituents —COOM or $—SO_3M$. Also, as the value for n increases, the value for u+v should be increased so that the compound will deposit better on the fabric during laundering. When the $R^3$ moieties have the substituent $-A[(R^2\text{-}A\text{-}R^4\text{-}A)]_wR^5O)_m(CH_2CH_2O)_nX$ (branched compounds) or $-A[(R^2\text{-}A\text{-}R^4\text{-}A)]_wR^2\text{-}A$-(cross-linked compounds), the value for w is typically at least 1 and is determined by the process by which the compound is made. For these branched and cross-linked compounds the value for u+v+w is from 3 to 25.

Preferred compounds of the present invention are block polyesters having the formula

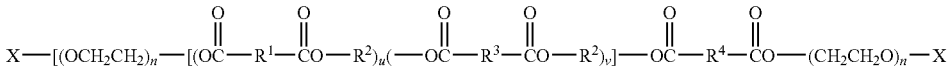

wherein the $R^1$ moieties are all 1,4-phenylene moieties; the $R^2$ moieties are essentially ethylene moieties, 1,2-propylene moieties or mixtures thereof; the $R^3$ moieties are all potassium or preferably sodium 5-sulfo-1,3-phenylene moieties or substituted 1,3-phenylene moieties having the substituent $$-\overset{O}{\overset{\|}{C}}O-[(R^2-O\overset{O}{\overset{\|}{C}}-R^4-\overset{O}{\overset{\|}{C}}O)]_w-(CH_2CH_2O)_n-X$$

at the 5 position; the $R^4$ moieties are $R^1$ or $R^3$ moieties, or mixtures thereof; each X is ethyl or preferably methyl; each n is from 12 to 43; when w is 0, u+v is from 3 to 10; when w is at least 1, u+v+w is from 3 to 10.

Particularly preferred block polyesters are those where v is 0, i.e. the linear block polyesters. For these most preferred linear block polyesters, u typically ranges from 3 to 8, especially for those made from dimethyl terephthalate, ethylene glycol (or 1,2-propylene glycol) and methyl capped polyethylene glycol. The most water soluble of these linear block polyesters are those where u is from 3 to 5.

In a preferred embodiment, the soil release polymers of the present invention have the formula (I):

$$X-[(OCH_2CH_2)_n(OR^5)_m]-[(A-R^1-A-R^2)_u(A-R^3-A-R^2)_v]-A-R^4-A-[R^5O)_m(CH_2CH_2O)_n]X$$

wherein each of the moieties A is selected form the group consisting of $$-\overset{O}{\overset{\|}{C}}O- \quad \text{or} \quad -\overset{O}{\overset{\|}{C}}O-$$

and combination thereof with either or both of the moieties, $$-\overset{O}{\overset{\|}{C}}\underset{H}{\underset{|}{N}}- \qquad -\overset{O}{\overset{\|}{C}}\underset{H}{\underset{|}{N}}-$$

wherein:

each of the $R^1$ moieties is selected from the group consisting of 1,4-phenylene and combination thereof with 1,3-phenylene, 1,2-phenylene, 1,8-naphthylene, 1,4-naphthylene, 2,2'-biphenylene, 4,4'-biphenylene and mixtures thereof. Alkylene and alkenylene moieties can be partially substituted including ethylene, 1,2-propylene, 1,4-butylene, 1,5-pentylene, 1,6-hexamethylene, 1,7-heptamethylene, 1,8-octamethylene, 1,4-cyclohexylene or mixtures thereof. In a more preferred embodiment, the $R^1$ moieties are 1,4-phenylene moieties, or are partially substituted with arylene, alkarylene, alkylene or alkenylene moieties, or mixtures thereof.

the $R^2$ moieties are selected from the group consisting of ethylene moieties, substituted ethylene moieties having $C_1$-$C_4$ alkyl or alkoxy substituents or mixtures thereof;

the $R^3$ moieties are substituted $C_2$-$C_{18}$ hydrocarbylene moieties having at least one —COOM, $-O[(R^5O)_m(CH_2CH_2O)_n]X$ or $-A[(R^2-A-R^4-A)_w(R^5O)_m(CH_2CH_2O)_n]X$ substituent;

the $R^4$ moieties are $R^1$ or $R^3$ or mixtures thereof.

each $R^5$ is $C_3$-$C_4$ alkylene, or the moiety $-R^2-A-R^6-$, wherein $R^6$ is a $C_1$-$C_{12}$ alkylene, alkenylene, arylene or alkarylene moiety;

M is H or a water-soluble cation; each X is $C_1$-$C_4$ alkyl; m and n are number such that the moiety $-(CH_2CH_2O)-$ comprise at least 50% by weight of the moiety $[(R^5O)_m(CH_2CH_2O)_n]$, provided that when $R^5$ is the moiety $-R^2-A-R^6-$, m is 1; n is at least 10; u and v are numbers such that the sum of u+v is from 3 to 25; w is 0 or at least 1; and when w is at least 1, u, v and w are numbers such that the sum of u+v+w is from 3 to 25.

In a more preferred embodiment, in the formula (I), each moieties A is $$-\overset{O}{\overset{\|}{C}}O- \quad \text{or} \quad -\overset{O}{\overset{\|}{C}}O-$$

Preferably, in the formula (I), v is 0. More preferably, in the formula (I), $R^1$ moieties comprise from 50 to 100% of said 1,4-phenylene moieties. Even More preferably each $R^1$ moieties is a 1,4-phenylene moiety.

In a more preferred embodiment, in the formula (I), the $R^3$ moieties are selected from the group consisting of substituted $C_2$-$C_{12}$ alkylene, alkenylene, arylene, alkarylene and mixture thereof. More preferably, $R^3$ moieties has only one substituent $-A[(R^2-A-R^4-A)]_w[(R^5O)_m(CH_2CH_2O)_n]X$ and w is 1.

In another preferred embodiment, in the formula (I), $R^2$ moieties comprise from 20 to 100%, preferably from 80 to 100% of ethylene moieties or substituted ethylene moieties Most preferably, in the formula (I), in the polymer according to the present invention m is 0 and n is from 12 to 119, more preferably form 12 to 43.

In preferred embodiments, the soil release polymer for use in the present invention has the formula (II):

$$X-[(OCH_2CH_2)_n-[(O\overset{O}{\overset{\|}{C}}-R^1-\overset{O}{\overset{\|}{C}}O-R^2)_u(-O\overset{O}{\overset{\|}{C}}-R^3-\overset{O}{\overset{\|}{C}}O-R^2)_v]-O\overset{O}{\overset{\|}{C}}-R^4-\overset{O}{\overset{\|}{C}}O-(CH_2CH_2O)_n-X$$

wherein:

each $R^1$ moieties is a 1,4-phenylene moiety;

the $R^2$ moieties are each selected from the group consisting of ethylene moieties, 1,2-propylene moieties, 1,2 butylene moieties, 1,2 hexylene moieties, 3-methoxy-1,2 propylene moieties or mixture thereof, provided that said $R^2$ are not exclusively 1,2 butylene moieties, 1,2 hexylene moieties, 3-methoxy-1,2 propylene moieties or mixture thereof;

the $R^3$ moieties are each selected from the group consisting of substituted 1,3-phenylene moieties having the substituent

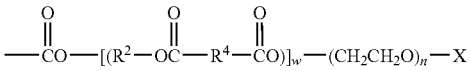

at the 5 position;

the $R^4$ moieties are $R^1$ or $R^3$ moieties, or mixtures thereof;

each X is $C_1$-$C_4$ alkyl; each n is from 12 to 43;

when w is 0, u+v is from 3 to 10;

when w is at least 1, u+v+w is from 3 to 10.

Preferably, in the formula (II), v is 0. More preferably, in the formula (II), $R^2$ moieties comprise from 80 to 100% ethylene moieties, 1,2-propylene moieties, or mixture thereof.

In the most preferred embodiment of the present invention, the soil release polymer has the formula:

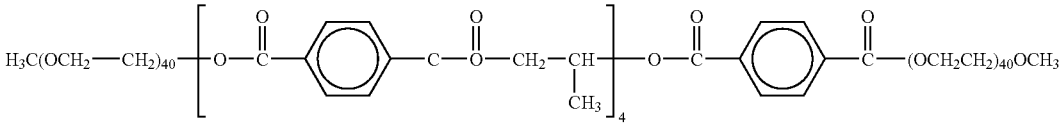

The soil release polymers of the present invention can be prepared by art-recognized methods. U.S. Pat. No. 4,702,857 and U.S. Pat. No. 4,711,730 describe the preferred method of synthesis for the block polyesters of the present invention.

Structurants

Suitable structurants include polymeric structurants such as those of the polyacrylate, polysaccharide or polysaccharide derivative type. Polysaccharide derivatives typically used as structurants comprise polymeric gum materials. Such gums include pectine, alginate, arabinogalactan (gum Arabic), carrageenan, gellan gum, xanthan gum and guar gum. Xanthan gum is the preferred structurant for use in the additive composition of the invention.

Also preferred are hydrogenated castor oil derivatives such as hydrogenated castor oil and hydrogenated castor wax. Commercially available, castor oil-based, crystalline, hydroxyl-containing structurants include THIXCIN® from Rheox, Inc. (now Elementis).

Preferably, the additive of the invention comprises from 0.05 to about 5%, more preferably from about 0.1 to about 2% and especially from about 0.1 to about 1% of structurant by weight of the additive.

Base Detergent

Detersive Surfactant

Compositions suitable for use herein comprises from 5% to 70% by weight, preferably from 10% to 60% by weight, more preferably from 20% to 50% by weight, of a certain kind of detersive surfactant component. Such an essential detersive surfactant component must comprise anionic surfactants, nonionic surfactants, or combinations of these two surfactant types. Preferably the detergent comprises at least 10%, more preferably at least 15% of anionic surfactant and at least 8% of non-ionic surfactant.

Suitable anionic surfactants useful herein can comprise any of the conventional anionic surfactant types typically used in liquid detergent products. These include the alkyl benzene sulfonic acids and their salts as well as alkoxylated or un-alkoxylated alkyl sulfate materials.

Preferred anionic surfactants are the alkali metal salts of $C_{10-16}$ alkyl benzene sulfonic acids, preferably $C_{11-14}$ alkyl benzene sulfonic acids. Preferably the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. Especially preferred are the sodium and potassium linear straight chain alkylbenzene sulfonates in which the average number of carbon atoms in the alkyl group is from about 11 to 14. Sodium $C_{11}$-$C_{14}$, e.g., $C_{12}$, LAS is especially preferred.

Another preferred type of anionic surfactant comprises ethoxylated alkyl sulfate surfactants. Such materials, also known as alkyl ether sulfates or alkyl polyethoxylate sulfates, are those which correspond to the formula:

$$R'—O—(C_2H_4O)_n—SO_3M$$

wherein R' is a $C_8$-$C_{20}$ alkyl group, n is from about 1 to 20, and M is a salt-forming cation. Preferably, R' is $C_{10}$-$C_{18}$ alkyl, n is from about 1 to 15, and M is sodium, potassium, ammonium, alkylammonium, or alkanolammonium. Most preferably, R' is a $C_{12}$-$C_{16}$, n is from about 1 to 6 and M is sodium.

The alkyl ether sulfates will generally be used in the form of mixtures comprising varying R' chain lengths and varying degrees of ethoxylation. Frequently such mixtures will inevitably also contain some unethoxylated alkyl sulfate materials, i.e., surfactants of the above ethoxylated alkyl sulfate formula wherein n=0. Unethoxylated alkyl sulfates may also be added separately to the compositions of this invention and used as or in any anionic surfactant component which may be present.

Preferred unalkoyxylated, e.g., unethoxylated, alkyl ether sulfate surfactants are those produced by the sulfation of higher $C_8$-$C_{20}$ fatty alcohols. Conventional primary alkyl sulfate surfactants have the general formula:

$$ROSO_3^-M^+$$

wherein R is typically a linear $C_8$-$C_{20}$ hydrocarbyl group, which may be straight chain or branched chain, and M is a water-solubilizing cation. Preferably R is a $C_{10}$-$C_{15}$ alkyl, and M is alkali metal. Most preferably R is $C_{12}$-$C_{14}$ and M is sodium.

Suitable nonionic surfactants useful herein can comprise any of the conventional nonionic surfactant types typically used in liquid detergent products. These include alkoxylated fatty alcohols, ethylene oxide (EO)-propylene oxide (PO) block polymers, and amine oxide surfactants. Preferred for use in the liquid detergent products herein are those nonionic surfactants which are normally liquid.

Preferred nonionic surfactants for use herein include the alcohol alkoxylate nonionic surfactants. Alcohol alkoxylates are materials which correspond to the general formula:

$$R^1(C_mH_{2m}O)_nOH$$

wherein $R^1$ is a $C_8$-$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol materials useful in the liquid detergent compositions herein will frequently have a hydrophilic-lipophilic balance (HLB) which ranges from about 3 to 17. More preferably, the HLB of this material will range from about 6 to 15, most preferably from about 8 to 15. Alkoxylated fatty alcohol nonionic surfactants have been marketed under the tradenames Neodol and Dobanol by the Shell Chemical Company.

Another type of nonionic surfactant which is liquid and which may be utilized in the compositions of this invention comprises the ethylene oxide (EO)-propylene oxide (PO) block polymers. Materials of this type are well known nonionic surfactants which have been marketed under the tradename Pluronic. These materials are formed by adding blocks of ethylene oxide moieties to the ends of polypropylene glycol chains to adjust the surface active properties of the resulting block polymers. EO-PO block polymer nonionics of this type are described in greater detail in Davidsohn and Milwidsky; Synthetic Detergents, 7th Ed.; Longman Scientific and Technical (1987) at pp. 34-36 and pp. 189-191 and in U.S. Pat. Nos. 2,674,619 and 2,677,700.

Yet another suitable type of nonionic surfactant useful herein comprises the amine oxide surfactants. Amine oxides are materials which are often referred to in the art as "semi-polar" nonionics. Amine oxides have the formula: $R(EO)_x(PO)_y(BO)_zN(O)(CH_2R')_2.qH_2O$. In this formula, R is a relatively long-chain hydrocarbyl moiety which can be saturated or unsaturated, linear or branched, and can contain from 8 to 20, preferably from 10 to 16 carbon atoms, and is more preferably $C_{12}$-$C_{16}$ primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

In the liquid detergent compositions herein, the essential detersive surfactant component may comprise combinations of anionic and nonionic surfactant materials. When this is the case, the weight ratio of anionic to nonionic will typically range from 100:1 to 1:100, more typically from 20:1 to 1:20.

Laundry Washing Adjuncts

The detergent compositions herein, preferably in liquid form, comprise from 0.1% to 30% by weight, preferably from 0.5% to 20% by weight, more preferably from 1% to 10% by weight, of one or more of certain kinds of laundry washing adjuncts. Such laundry washing adjuncts can be selected from detersive enzymes, builders, chelants, soil release polymers, soil suspending polymers, optical brighteners, dye transfer inhibition agents, bleach, whitening agents, suds suppressors, fabric care benefit agents, solvents, stabilizers, buffers, structurants, dyes and perfumes and combinations of these adjunct types. All of these materials are of the type conventionally utilized in laundry detergent products.

Detersive Enzymes

Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, mannanases?, pentosanases, malanases, β-glucanases, arabinosidases, hyaluronidase, chondroitinase, laccase, and known amylases, or combinations thereof. A preferred enzyme combination comprises a cocktail of conventional detersive enzymes like protease, lipase, cutinase and/or cellulase in conjunction with amylase. Detersive enzymes are described in greater detail in U.S. Pat. No. 6,579,839.

If employed, enzymes will normally be incorporated into the base detergent compositions herein at levels sufficient to provide up to 10 mg by weight, more typically from about 0.01 mg to about 5 mg, of active enzyme per gram of the composition. Stated otherwise, the aqueous liquid detergent compositions herein can typically comprise from 0.001% to 5%, preferably from 0.01% to 1% by weight, of a commercial enzyme preparation. Protease enzymes, for example, are usually present in such commercial preparations at levels sufficient to provide from 0.005 to 0.1 Anson units (AU) of activity per gram of detergent composition.

Suds Suppressors

The base detergent herein preferably comprise one or more materials which act as suds suppressors to minimize oversudsing of the compositions herein when they are employed for laundering of fabrics in professional automatic washing machines. Frequently, suds suppressor systems are based on silicones or silica-silicone combinations. Examples of suitable suds suppressors for use herein are disclosed in U.S. Pat. Nos. 5,707,950 and 5,728,671. A preferred suds suppressor is a polydimethylsiloxane compounded with silica.

If employed, suds suppressors will typically be incorporated in concentrations ranging from 0.001% to 2% by weight. More preferably, suds suppressors can comprise from 0.01% to 1% by weight of the compositions herein.

The additive and/or the base detergent may also include from about 0.05 to about 0.5% of preservatives non-limiting examples of which include didecyl dimethyl ammonium chloride which is available under the tradeneme UNIQUAT (from Lonza of Basel Switzerland), 1,2-benzisothiozolin-3-one, which is available under the tradename PROPEL (from Arch Chemicals of Norwalk, Conn.), dimethylol-5,5-dimethylhydantoin which is available under the tradeneme DANTOGUARD (from Lonza of Basel Switzerland), 5-Chloro-2-methyl-4-isothiazolin-3-one/2-methyl-4-isothiazolin-3-one, which is available under the tradename KATHON (from Rohm and Haas of Philadelphia, Pa.), and mixtures thereof.

Other Fabric Care Benefit Agents

The base detergent or additives for use herein (separate additive from the soil release additive) may also comprise additional fabric care or benefit agents which can be deposited onto fabrics being laundered and which thereupon provide one or more types of fabric care or treatment benefits. Such benefits can include, for example, fabric softness, anti-static effects, ease-of-ironing benefits, anti-abrasion benefits, anti-pilling effects, color protection, wrinkle removal or improved resistance to wrinkling, fabric substantive perfume or odor benefits, malodor protection benefits, and the like.

A wide variety of materials which are suitable for providing such benefits and which can be deposited onto fabrics being laundered are known in the art. Such materials can include, for example, clays; starches; polyamines; un-functionalized and functionalized silicones such as aminosilicones and quaternary nitrogen-containing cationic silicones; cellulosic polymers, and the like. Materials of these types are described in greater detail in one or more of the following publications: U.S. Pat. No. 6,525,013; U.S. Pat. No. 4,178,254; WO 02/40627; WO 02/18528; WO 00/71897; WO 00/71806; WO 98/39401; and WO 98/29528.

If employed, such additional fabric care benefit agents polymers can typically be incorporated into the liquid laundry detergent compositions herein in concentrations ranging from 0.05% to 20%, by weight, depending upon the nature of the materials to be deposited and the benefit(s) they are to provide. More preferably, such fabric care benefit agents can comprise from 0.1% to 10%, by weight of the composition.

EXAMPLE

The washing test was carried out using Electrolux W465H industrial washing machines. The washes were carried out at 40° C. (10 minutes main-wash time), and were followed by 3 cold-water rinses, all using soft water (0° dH). The fabrics were successively dried using Miele Professional 5206 tumble dryer.

The fabric load included 3 kg of clean ballast load, composed of 67% cotton and 33% polycotton, and tracers (approximately 200 grams) to be stained. Four types of tracers were used (i) 100% "filamented" polyester (jersey polyester); (ii) 100% "spun" polyester (from Royal Crest); (iii) aged cotton tea towels (purchased from consumers) and (iv) aged polycotton shirts (purchased from consumers)

The detergent used had the following composition and it was used at a dosage of 48 grams/machine (or 9.6 ml/kg fabric). The detergent was delivered into the main-wash cycle.

TABLE 1

| Ingredient | % by weight |
|---|---|
| C12-alkylbenxene sulfonic acid | 12.2 |
| Non-ionic surfactant | 8.25 |
| C12-alkyl trimethyl amine N-oxide | 1.5 |
| C12-14 fatty acid | 8.3 |
| Citric acid | 3.4 |
| Triethyleneimine penta phosphonic acid | 0.19 |
| Ethoxylated polymine polymer | 1.1 |
| Enzymes | 0.50 |
| 1,2 propandiol | 4.9 |

TABLE 1-continued

| Ingredient | % by weight |
|---|---|
| Ethanol | 2.8 |
| Monethanolamine | 0.83 |
| Monoethanaolamine borate | 2.4 |
| Cumene sulfonic acid | 1.9 |
| Silicone suds suppressor | 0.13 |
| Hydrogenated castor oil | 0.10 |
| Perfume and minors | 0.5 |
| Sodium hydroxide | to pH 8.0 |
| water | Balance |

The detergent yielded wash pH's of about 8.

An additive comprising soil release polymer was delivered in the last rinse cycle. The additive had the composition specified in Table 2.

TABLE 2

| Ingredient | % by weight |
|---|---|
| Polyethylene terephtalate-poloxyethylene terephtalate copolymer, methyl capped* | 10.0 |
| Xanthan gum | 0.25 |
| Dye, preservative | 0.3 |
| Water | balance |

*Texcare SRN 240, ex Clariant

The additive was added in the last rinse cycle, at a dosage of 0.5-2.0 ml/kg fabric (corresponding to 0.05-0.2 grams of active polymer/kg of fabric).

After drying, a fraction of the tracers were removed. The remaining tracers were used for 3 successive wash cycles identical to the one described above, thus they were washed 4 times in total.

As control treatment, identical tracers were washed 1 or 4 times using an identical wash cycle, but without the addition of the grease release composition in the last rinse.

All the tracers obtained in the washes described were then soiled, using the soils listed in Table 3 here below. The tracers were then washed once, using the same washing protocol described above. The control tracers were also washed using the same protocol, but without the additive in the last rinse.

After drying the soiled tracers were evaluated for soil removal, versus the corresponding tracers which had not been treated with the grease release composition.

The evaluation was done by visual grading by two expert graders, and their grades were averaged. Four replicates of the same stain were used, and the grades of all replicates were also averaged.

The grading is done according to the Panel Score Unit (PSU) scale, defined as follows:

0 There is no difference

1 I think there is a difference

2 I am sure there is a difference

3 There is a large difference

4 There is an extremely large difference

The grades are used with a + sign if the test is better than the control, and a − sign if the test product is poorer than the control. The cleaning grades obtained by the test products on the individual stains are shown in Table 3.

TABLE 3

| PSU grades for spun polyester fabrics rinsed 4 times with the additive versus control fabrics rinsed with water alone: | | | | |
|---|---|---|---|---|
| Stains | 0.25 gram/kg | 0.5 gram/kg | 0.75 gram/kg | 1 gram/kg |
| Spun polyester fabrics | | | | |
| olive oil | +1 | +0.8 | +0.8 | +0.5 |
| ketchup | +0.1 | +1.3 | +1.0 | 0.0 |
| Andalouse sauce | +1.2 | +1.5 | −0.3 | −1.0 |
| Corn oil | +1.2 | +1.5 | +1.0 | +1.0 |
| Pork fat | +1.0 | +0.9 | 0.0 | +0.5 |
| Shoe polish | −0.5 | +1.5 | −0.5 | −0.5 |
| lipstick | +1.2 | +1.6 | +2.0 | +0.5 |
| make-up | −0.2 | +0.8 | +1.0 | +0.5 |
| Average | +0.7 | +1.2 | +0.6 | +0.1 |
| Filamented polyester fabrics | | | | |
| Olive oil | +1.5 | +0.2 | +1.2 | +1.5 |
| Ketchup | +2.2 | +1.9 | +2.5 | +1.0 |
| Andalouse sauce | +2.5 | +2.5 | +3.5 | +1.7 |
| Corn oil | +1.5 | +0.5 | +1.0 | +0.5 |
| Pork fat | +2.6 | +1.2 | +2.9 | +1.0 |
| Shoe polish | +2.4 | +2.7 | +3.6 | +2.5 |
| lipstick | +1.9 | +0.1 | +4.0 | +2.0 |
| make-up | +1.2 | +0.1 | +0.2 | −1.2 |
| Average | +1.6 | +1.1 | +2.3 | +1.1 |

The results clearly show that the fabrics rinsed with the additive are much more easily cleaned than fabrics rinsed with water alone. Furthermore, the data show that, surprisingly, low levels of additive (0.5-0.75 gram/kg corresponding to 0.05/0.075 grams of soil release polymer/kg fabric) provide better results than higher levels (0.1 grams of soil release polymer).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A method of cleaning a textile load comprising polyester items in a professional laundry machine, wherein the method comprises repeatedly subjecting the polyester items to main-wash, rinse and optionally pre-wash cycles, wherein the load is contacted during a rinse cycle with a liquor containing an external structurant and a soil release polymer, wherein the level of soil release polymer per kilogram of load is from about 0.01 to about 0.075 grams, wherein the external structurant is a polymeric structurant, wherein the polymeric structurant is a polymeric gum material selected from the group consisting of pectine, alginate, arabinogalactan (gum Arabic), carrageenan, gellan gum, xanthan gum, guar gum, and mixtures thereof, wherein said soil release polymer has the following formula:

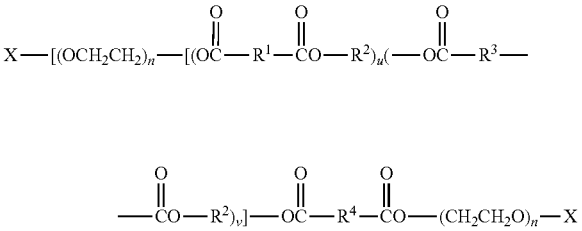

wherein:

each $R^1$ moieties is a 1,4-phenylene moiety;

the $R^2$ moieties are each selected from the group consisting of ethylene moieties, 1,2-propylene moieties, 1,2butylene moieties, 1,2hexylene moieties, 3-methoxy-1,2propylene moieties or mixture thereof, provided that said $R^2$ are not exclusively 1,2 butylene moieties, 1,2hexylene moieties, 3-methoxy-1,2propylene moieties or mixture thereof;

the $R^3$ moieties are each selected from the group consisting of substituted 1,3-phenylene moieties having the substituent

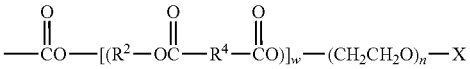

at the 5 position;

the $R^4$moieties are $R^1$ or $R^3$ moieties, or mixtures thereof;

each X is C1-C4 alkyl; each n is from 12 to 43;

when w is 0, u+v is from 3 to 10;

when w is at least 1, u+v+w is from 3 to 10, and wherein said soil release polymer is provided is an additive.

2. A method according to claim 1, wherein the soil release polymer is a copolymer comprising propylene glycol derived moieties, terephthalate moieties and capped polyethylene glycol derived moieties preferably having the formula:

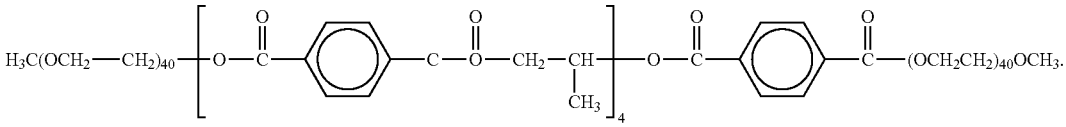

3. A method according to claim 1 wherein the soil release polymer has a molecular weight of at least about 2000 MW.

4. A method of cleaning according to claim 1 wherein the wash liquor comprises a suds suppressor.

5. A method of cleaning according to claim 4 wherein the wash liquor has a hardness of less than 1 mmole/liter.

6. A method of cleaning according to claim 5 wherein the wash liquor has a pH of from about 7 to about 9.

7. A method of cleaning according to claim 6 comprising the additional step of delivering starch simultaneously or after the soil release polymer.

8. The method of claim 1, wherein the external structurant comprises xanthan gum.

9. The method of claim 1, wherein the additive is free of surfactant.

10. The method of claim 1, wherein the level of soil release polymer per kilogram of load is from about 0.025 to about 0.075 grams.

11. The method of claim 1, wherein the polyester items are re-used between main-wash, rinse and optionally pre-wash cycles.

* * * * *